United States Patent [19]

Danyo

[11] 4,050,484

[45] Sept. 27, 1977

[54] LIQUOR-FLOATING DEVICE

[76] Inventor: Eugene Danyo, 1431 Windsor Drive, Toms River, N.J. 08753

[21] Appl. No.: 707,869

[22] Filed: July 22, 1976

[51] Int. Cl.[2] ..... B65B 1/14

[52] U.S. Cl. ..... 141/34; 141/98; 141/331

[58] Field of Search ..... 141/98, 331-345, 141/363-366, 34, 9, 100, 31

[56] References Cited

U.S. PATENT DOCUMENTS

| | | | |
|---|---|---|---|
| 3,256,916 | 6/1966 | Silletti | 141/366 |
| 3,963,063 | 6/1976 | Pascarella | 141/364 |

*Primary Examiner*—Houston S. Bell

*Attorney, Agent, or Firm*—Charles F. Gunderson

[57] ABSTRACT

A device for floating one liquid on top of another for special effects in mixing drinks and the like includes a funnel-like upper cup portion with a large, upper end or opening to receive liquids and a smaller, lower end attached to and surrounding a shaft portion. Relatively small openings are provided between the lower end of the funnel-like cup portion and the shaft portion to allow a liquid to escape from the funnel-like cup portion, at a relatively slow rate, and run down the sides of the shaft. When the lower end of the shaft portion is immersed in another liquid, the liquid flowing down the sides of the shaft will meet and spread out over the surface of the other liquid, if the one liquid is less dense than the other liquid.

10 Claims, 5 Drawing Figures

FIG. 1
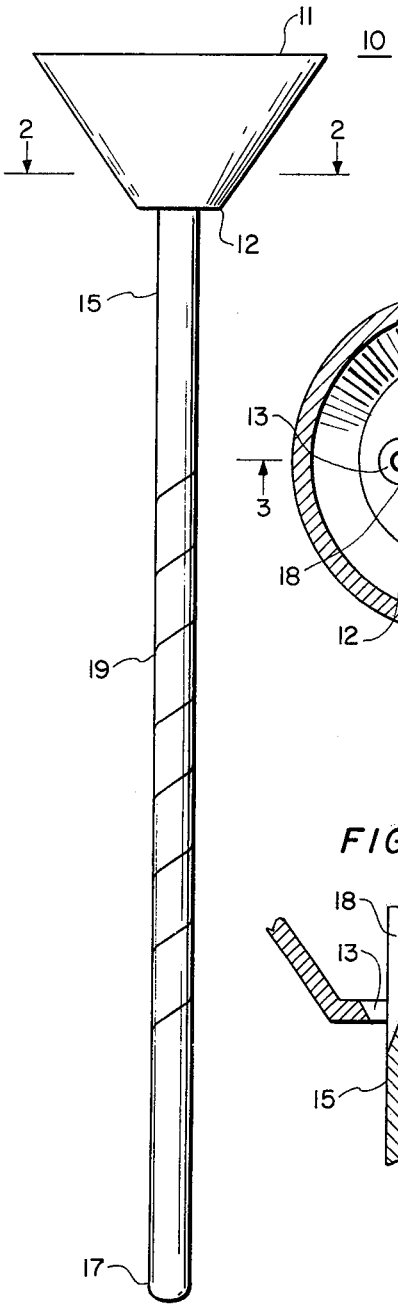
FIG. 2
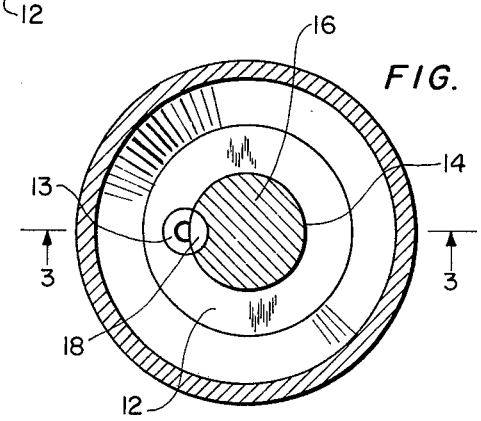
FIG. 4
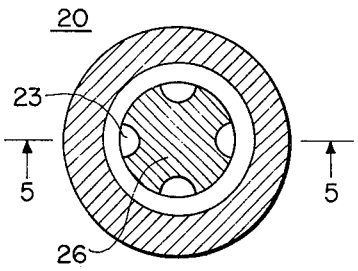
FIG. 3
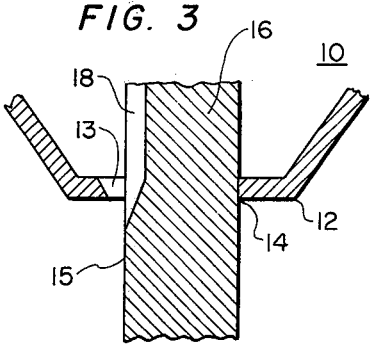
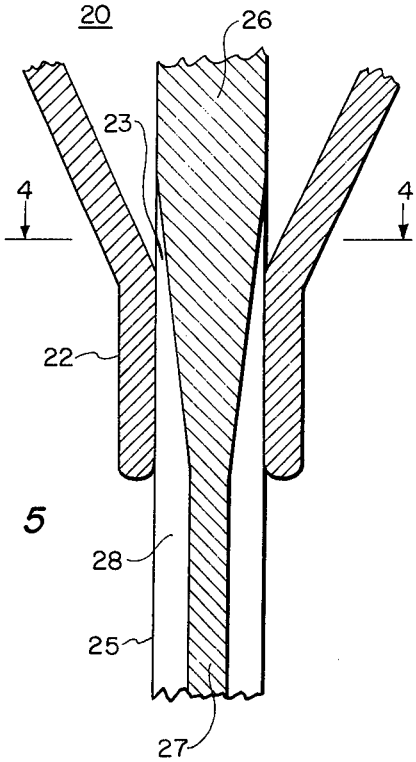
FIG. 5

LIQUOR-FLOATING DEVICE

BACKGROUND OF THE INVENTION

When a bartender is required to mix drinks of certain types, such as a "pousse cafe", a "port and starboard", etc., he has the tedious task of floating one liquid on top of another, which requires a very steady hand and considerable skill, as well as time. Consequently, requests for floated types of cocktails are subtly discouraged as much as possible, and, when attempted, often ruined, causing waste of expensive materials, irritation to the bartender, and delay to the customers.

In the past, floating liquids on top of one another was done by pouring a liquid down the side of glass, very carefully, or pouring a liquid down the shaft of a bar spoon or swizzle stick; where the friction of the side of the glass, or shaft of the bar spoon or swizzle stick slowed down the flow of the liquid to the degree where it would "float" on top of another liquid of a heavier density. This operation, obviously, takes a high degree of skill, a steady hand, and patience; particularly when several liquids are being floated and any one of the operations may be unsuccessful and spoil the effect.

It is therefore an object of this invention to provide a device that can, very simply, and in an almost foolproof manner, provide a means for floating one liquid on top of another; wherein the speed of flow of the one liquid can be reduced to a degree that will not agitate the other, under layer; wherein the floatation will be predictable and smooth, and wherein the operation will be so simple that a comparatively inexperienced person can make the drink almost without failure.

SUMMARY OF THE INVENTION

These objects are accomplished by the combination of a funnel-like cup and a shaft. The lower end of the shaft may be positioned in a glass into which a liquor is to be floated, and the funnel-like cup may serve as a reservoir for a liquor that is to be floated on top of another liquor in the glass. The shaft extends through the smaller, lower end of the funnel-like cup, and a hole or slot is provided, between the lower end of the cup portion and the shaft portion, to release the liquor, at a reduced rate of flow, along the sides of the shaft, to settle on top of the upper layer of liquor in the glass.

BRIEF DESCRIPTION OF THE DRAWINGS

FIG. 1 shows a side view of a typical embodiment of this invention;

FIG. 2 shows a top view of a cross section of a portion of FIG. 1.

FIG. 3 shows a cross section of a portion of FIG. 2.

FIG. 4 shows a cross section of the top view of another species to the invention; and FIG. 5 shows a cross section of a portion of the species of FIG. 4.

DESCRIPTION OF THE PREFERRED EMBODIMENT

Referring now more particularly to FIG. 1, a side view is shown of a typical embodiment of this invention with a funnel-like cup portion 10 having an enlarged upper end or opening 11 and a smaller, lower end 12. A shaft portion 15 extends through the lower end of the cup portion. The shaft 15 has an upper end, not seen in FIG. 1, and a lower end 17. The shaft may be twisted, in a well-known manner to provide a spiraling 19.

FIG. 2 shows a top view of an enlarged cross section of a portion of FIG. 1 along the lines 2—2, wherein the same elements have the same numbers. This includes a part of the cup 10, and the lower end 12, a part of the upper end 16 of the shaft portion is also seen, as well as a weld area 14 that secures the lower end 12 of the cup portion to the shaft portion. In this figure a hole 13 is seen, that extends through the lower end of the cup portion, and also joins an opening or slot 18 that extends into the shaft portion.

FIG. 3 shows a cross section of the portion of the device shown in FIG. 2, along the lines 3—3 wherein the same elements have the same numbers. This figure clearly illustrates the lower end 12 of the cup portion 10, with the shaft portion 15, that extends through the lower end and is welded to the lower end at 14. FIG. 3 also shows the hole 13 through the lower end of the cup portion and the opening or slot 18, that joins the hole 13, along the upper end of the shaft portion.

FIG. 4 shows a top view of a cross section of another shaft portion and funnel-like cup portion 20 similar to that of the cross section of FIG. 2 with tapered slots 23 in the upper end 26 of the shaft portion.

FIG. 5 shows a side view of a cross section of the species of FIG. 4 along the lines 5—5. Here again the same elements are similarly numbered. However, here the funnel-like cup portion 20 has a smaller, lower end 22 that fits tightly about a shaft portion 25, a part of the upper end 26 of the shaft portion is seen extending through the lower end of the cup portion. In this species the shaft has slots 28 along the axis of the shaft to provide the openings and the slots are tapered at 23 to control the size of the openings.

In operation, the shaft portions 15 or 25 may be held in a substantially vertical position with the corresponding lower end 17 or 27 resting in a glass, or other receptical, not shown, that contains, or is to contain a plurality of liquors.

A measured amount of a given liquor may be poured into the funnel-like cup portion 10, for example, to flow at a desired rate through the hole 13 and slot 18 and along the shaft 15 to the lower end of the shaft. The size of the hole and slot controls the rate of flow of the liquid, and the affinity of the liquor to the shaft contains the liquor and slows its rate of flow.

When the given liquor reaches the lower end of the shaft, or the top surface of any other liquor, not shown, in the glass, the given liquor will spread out on the surface of the other liquor because of its slow velocity, rather than penetrating and dispersing through the other, lower layer of liquor. After one layer of liquor is floated on top of the previous layer, other liquors, in order of density, can be floated on each other until the drink is completed.

The optimum rate of flow of the liquors may be predicted and monitored through the hole 13 and slot 18 to a rate that provides consistent floatation. However, for different liquors, or different situations, or operators, it may be desireable to vary the rate of flows. This may be done by changing the size of the hole 13 or slot 18, or by changing the position of the lower end 22 of the cup portion on the tapered slot 23 of the shaft 25 of the species of FIGS. 4 and 5.

While only one hole is shown in FIGS. 1—3, it is obvious that several holes may be provided, as long as each hole is in direct contact with the shaft, or is associated with a slot, such as 18, along the shaft, so that all the liquor flowing out of the cup portion must flow along the shaft portion. This controls the direction as well as the rate of flow of the liquor, since the friction of a given liquor flowing along the shaft portion is an important factor in its gentle floating on the surface of another previous liquor at the bottom of the shaft.

The species of FIGS. 4 and 5 suggest one of several means for varying the apertures of the holes or slots and controlling the rate of flow of the liquors to meet any situation. Four slots such as 23 along the shaft provide the holes and insure an intimate contact of the liquid with the shaft. The taper of the slots at 23 provides a variation of the effective size of the slots or holes. While only four slots 23 are shown here, for simplicity, there is, of course, no limit to the number, and placement of the holes or slots.

In the species of FIGS. 4 and 5, the lower end 22 of the funnel-like cup portion is seen to fit tightly around the shaft portion 25. Here the friction of the lower end 22 against the shaft should be enough to hold the cup portion, and its lower end in position during the entire operation. However the lower end 22 of the funnel-like portion should be slideable, to be moved up or down along the tapered slots in the shaft portion, to vary the rate of flow, or to remove the cup portion for cleaning or storing.

The same may be true for FIGS. 1-3. The weld 14 may be replaced with a friction coupling, or a threaded coupling, that may control, in one way or another, the aperture of the hole, and the flow of the liquor, or merely to provide a means for separating the funnel-like cup and shaft portions for cleaning or storing.

In operation, the device may be held by the cup portion 10 or 20 while the liquor is being poured into the cup. However, it may be more effective to extend the shaft portion further through the cup portion until its upper end 16 or 26 extends well above the cup portion. The upper end of the shaft may then be held by the operator, well above the cup portion, while the liquor is being poured into the cup portion.

With a valve, or a control of the flow of the liquor in one way or another, it would be possible to stop the flow of liquor while a measured amount of a given liquor is being poured into the cup portion, and then to open the valve to -let the given liquor flow slowly down the shaft. This would provide a precise amount of each liquor being added and improve the effect of the cocktail.

While the funnel-like cup portions in both species is shown in a tapered form, it is obvious that any of several shapes may be used as long as the liquor can be conveniently poured into the upper opening and all the liquor will drain out of the bottom holes along the shaft portion.

Many stirring rods have a spiral portion for asthetic or ornamental effect. This is desireable here, since the spiral will tend to further slow down the flow of the liquors. If the sprial 19 were exagerated into a thread, it would also provide a centrifugal effect to cast a given liquor over the surface of another liquid already in a glass, as it strikes the surface, rather than flowing straight downward into the previous layer, which would be more likely to mix the liquor.

It is understood that I do not desire to be limited to the exact details of construction shown and described since obvious modifications will occur to a person skilled in the art.

Having thus described my invention, what is claimed is:

1. A device for controlling the flow of a liquor into a glass comprising:

a funnel-like cup portion having an enlarged upper opening and a smaller lower end;

an elongated shaft portion having an upper end and a lower end, said shaft portion extending axially through said smaller lower end of said cup portion; and at least one orifice between said cup portion and said shaft portion, said orifice being directed toward, and extending into, said shaft portion, whereby said liquor, poured into said cup portion, will flow, at a controlled rate, through said orifice, down along the sides of said shaft portion.

2. A device for controlling the flow of a liquor into a glass as in claim 1 wherein said funnel-like cup portion is a conventional taper, liquid-measuring device.

3. A device for controlling the flow of a liquor into a glass as in claim 1 wherein said shaft portion is a conventional stirring rod.

4. A device for controlling the flow of a liquor into a glass as in claim 1 wherein said orifice between said cup portion and said shaft portion is a hole drilled through said smaller lower end of said cup portion and extending into said shaft portion.

5. A device for controlling the flow of a liquor into a glass as in claim 1 wherein said orifice is tapered towards its lower end to reduce the flow of said liquor and direct it against said shaft portion.

6. A device for controlling the flow of a liquor into a glass as in claim 1 wherein said shaft portion includes at least one axial slot to provide said orifice.

7. A device for controlling the flow of a liquor into a glass as in claim 6 wherein said smaller lower end of said cup portion has a central opening to surround said shaft portion along said axial slot.

8. A device for controlling the flow of a liquor into a glass as in claim 6 wherein said cup portion comprises a funnel-like unit whose smaller lower end is a spout that forms a tight, slidable coupling along said portion around said axial slot.

9. A device for controlling the flow of a liquor into a glass as in claim 8 wherein said axial slot has an increasing depth along said shaft portion, and the position of said spout of said cup portion along said axial slot controls the flow of said liquor.

10. A device for controlling the flow of a liquor into a glass in claim 6 wherein said axial slot is spiraled around said shaft to reduce the speed of flow of said liquor.

* * * * *